US007505726B2

(12) United States Patent
Tokuhiro et al.

(10) Patent No.: US 7,505,726 B2
(45) Date of Patent: Mar. 17, 2009

(54) FIXING DEVICE AND IMAGE FORMATION APPARATUS

(75) Inventors: Eiichiro Tokuhiro, Kanagawa (JP); Kimihiro Wakabayashi, Kanagawa (JP); Kenji Kanai, Kanagawa (JP); Makoto Fuchigami, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 56 days.

(21) Appl. No.: 11/508,171

(22) Filed: Aug. 23, 2006

(65) Prior Publication Data

US 2007/0048044 A1 Mar. 1, 2007

(30) Foreign Application Priority Data

Aug. 24, 2005 (JP) ..... P2005-242023

(51) Int. Cl.
*G03G 15/20* (2006.01)

(52) U.S. Cl. ..... 399/329; 219/216

(58) Field of Classification Search ..... 399/329, 399/328, 126; 219/216
See application file for complete search history.

(56) References Cited

U.S. PATENT DOCUMENTS 5,666,624 A * 9/1997 Kanesawa et al. ..... 399/329
5,960,243 A * 9/1999 Daigo et al. ..... 399/329
5,999,788 A 12/1999 Kanesawa et al. ..... 399/329
7,167,670 B2 * 1/2007 Obata et al. ..... 399/329
2003/0219269 A1 * 11/2003 Asayama ..... 399/67
2005/0141932 A1 * 6/2005 Sugiyama ..... 399/328
2005/0185996 A1 * 8/2005 Oishi et al. ..... 399/329
2006/0083561 A1 * 4/2006 Takemura ..... 399/329
2006/0257180 A1 * 11/2006 Nakagawa et al. ..... 399/329

FOREIGN PATENT DOCUMENTS

CN 1508637 6/2004
JP A-11-133776 5/1999

* cited by examiner

*Primary Examiner*—Sophia S Chen
(74) *Attorney, Agent, or Firm*—Morgan, Lewis & Bockius LLP

(57) ABSTRACT

A fixing device includes a cylindrical fixing roller, an endless belt and a pressure member. The endless belt rotates along with the fixing roller. The endless belt is disposed at a position facing the fixing roller. The pressure member is disposed inside the endless belt. The pressure member pressurizes the fixing roller via the endless belt. The pressure member includes a contact member and an adjustment member. The contact member directly contacts with the endless belt. The adjustment member adjusts distribution of pressure given to the contact member.

7 Claims, 6 Drawing Sheets

FIXING DEVICE AND IMAGE FORMATION APPARATUS

BACKGROUND

1. Technical Field

The invention relates to a fixing device for fixing an image formed on a sheet of paper by a copier, a printer or a facsimile of an electrophotography system, and an image formation apparatus using the fixing device.

2. Related Art

There is an image formation apparatus of the electrophotography system such as a copier and a printer, in which a fixing device for fixing a toner image transferred to a record medium such as paper uses a belt nip system. This fixing device causes a recording medium to pass through a nip portion formed of a heating roll and an endless pressure belt having a contact member inside the periphery of the belt, to thereby fix the toner onto the recording medium.

The contact member usually is made of a rigid body such as metal. The contact member has a staircase shape on its bottom, so that dimension variations of adjacent members hardly affects the contact member and desired pressure distribution in the nip portion can be achieved. Further, the staircase shape facilitates optimization of the pressure distribution. Thus, in manufacturing the contact member according to the related art, metal material is extruded out of a mold to form an outer shape of the contact member and then, a complicated staircase shape at its bottom is formed by press working.

However, in order to form the contact member, the complicated staircase shape is formed on the bottom of the contact member by press working as mentioned above. Thus, manufacturing of the contact member requires time and labor and the cost increases.

SUMMARY

According to an aspect of the invention, a fixing device includes a cylindrical fixing roller, an endless belt and a pressure member. The endless belt rotates along with the fixing roller. The endless belt is disposed at a position facing the fixing roller. The pressure member is disposed inside the endless belt. The pressure member pressurizes the fixing roller via the endless belt. The pressure member includes a contact member and an adjustment member. The contact member directly contacts with the endless belt. The adjustment member adjusts distribution of pressure given to the contact member.

BRIEF DESCRIPTION OF THE DRAWINGS

Exemplary embodiments of the invention will be described in detail based on the following figures, wherein.

DETAILED DESCRIPTION

Referring now to the accompanying drawings, exemplary embodiments of the invention will be described.

Figure 7:
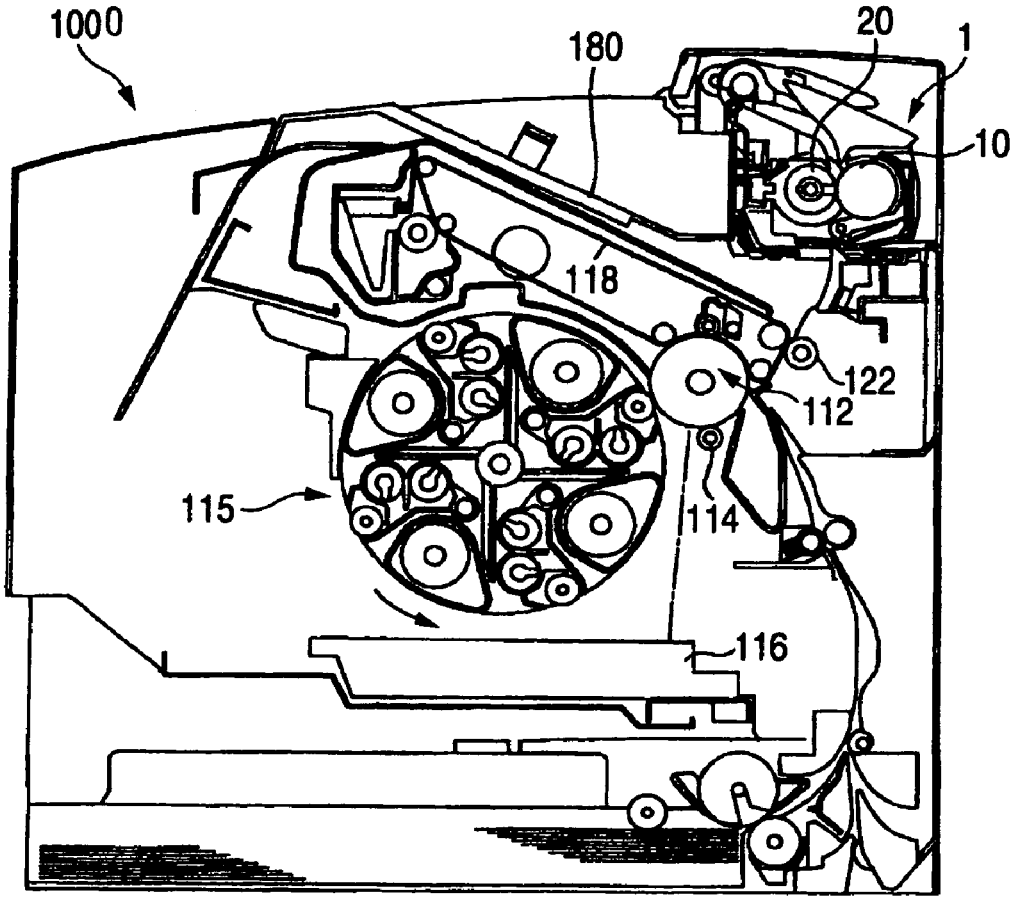
FIG. 7 is a schematic sectional view of an image formation apparatus including the fixing device according to the exemplary embodiment.

FIG. 7 is a schematic sectional view of an image formation apparatus 1000 including a fixing device 1 according to an exemplary embodiment. The image formation apparatus 1000 includes a photosensitive drum 112, a charging roller 114, a laser exposing device 116, a developing device 115, an intermediate transfer belt 118, a transfer roller 122, the fixing device 1 and a discharge tray 180. The photosensitive drum 112 is disposed to be rotatable. The charging device 114 charges the photosensitive drum 112. The laser exposing device 116 exposes the charged photosensitive drum 112 to light (laser beam) to form an electrostatic latent image on the photosensitive drum 112. The developing device 115 develops the thus-formed electrostatic latent image with toner to visualize the electrostatic latent image, that is, to form a toner image on the photosensitive drum 112. Then, the toner image on the photosensitive drum 112 is transferred onto the intermediate transfer belt 118. The transfer roller 122 transfers the toner image, which has been transferred onto the intermediate transfer belt 118, onto a recording medium such as a sheet of paper. The fixing device 1 applies heat and pressure to the recording medium onto which the toner image has been transferred, to fix the toner image on the recording medium. The recording medium, which is undergone the fixing process, is discharged to the discharge tray 180.

Figure 1:
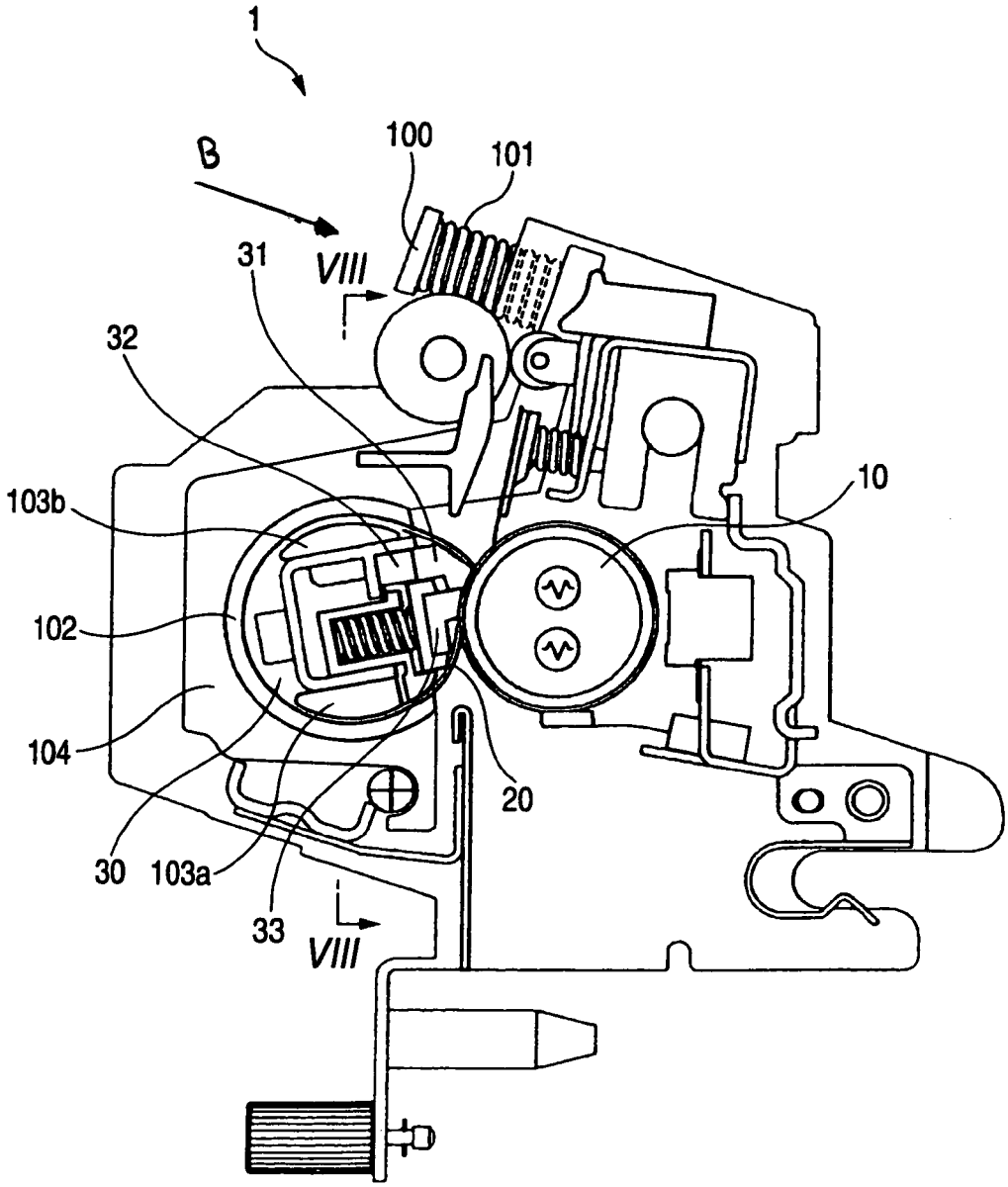
FIG. 1 is a schematic sectional view to describe a fixing device of an image formation apparatus according to an exemplary embodiment of the invention.

FIG. 1 is a schematic sectional view to describe the fixing device 1 of the image formation apparatus according to this exemplary embodiment. That is, a fixing device 1 includes a cylindrical fixing roller 10, an endless belt 20 and a pressure member 30. The endless belt 20 rotates along with the fixing roller 10. The endless belt 20 is disposed at a position facing the fixing roller 10. The pressure member 30 is disposed inside the endless belt 20. The pressure member 30 pressurizes the fixing roller 10 via the endless belt 20. The pressure member 30 includes a contact member 31 and an adjustment member 32. The contact member 31 directly contacts with the endless belt 20. The adjustment member 32 adjusts distribution of pressure given to the contact member 31.

The fixing roller 10 has a heat-resistant elastic body and a mold release layer, which are formed on the peripheral of a metal cylindrical core. A heating source such as a halogen lamp is placed inside the cylindrical core. A temperature sensor measures the surface temperature of the fixing roller 10. A temperature measurement signal is sent to a temperature controller, and an adjustment is made by feedback control so that the surface becomes a constant temperature.

The endless belt 20 is in contact with the fixing roller 10 so that the endless belt 20 is wound around the fixing roller 10 at a predetermined angle, to thereby form a nip portion therebetween. The endless belt 20 rotates along with rotation of the fixing roller 10, so as to press a sheet of paper while pinching a sheet of paper in the nip portion to convey the sheet of paper in the conveyance direction.

The pressure member 30 is placed inside the endless belt 20 to give a pressure to the nip portion via the endless belt 20.

The pressure member 30 includes separate members of the contact member 31 and the adjustment member 32 for adjusting the pressure to the contact member 31. This structure is described later.

A pressure pad 33 is placed adjacent to the contact member 31, which presses the endless belt 20. In order to provide a wide nip portion, the pressure pad 33 is made of an elastic material. The pressure pad 33 is urged from the inside of the pressure member 30 to the outside of the pressure member 30 by a spring so as to press the endless belt 20 on a front side of the contact member 31 in a process direction. An optimum pressure distribution along the process direction in the nip portion is set according to the pressure balance between the pressure pad 33 and the contact member 31.

The pressure distribution in the nip portion is adjusted so as to gradually rise in the portion of the pressure pad 33 and have the highest pressure in a projection portion of the contact member 31. Accordingly, it is made possible to reliably fix a toner image onto paper.

Figure 2:
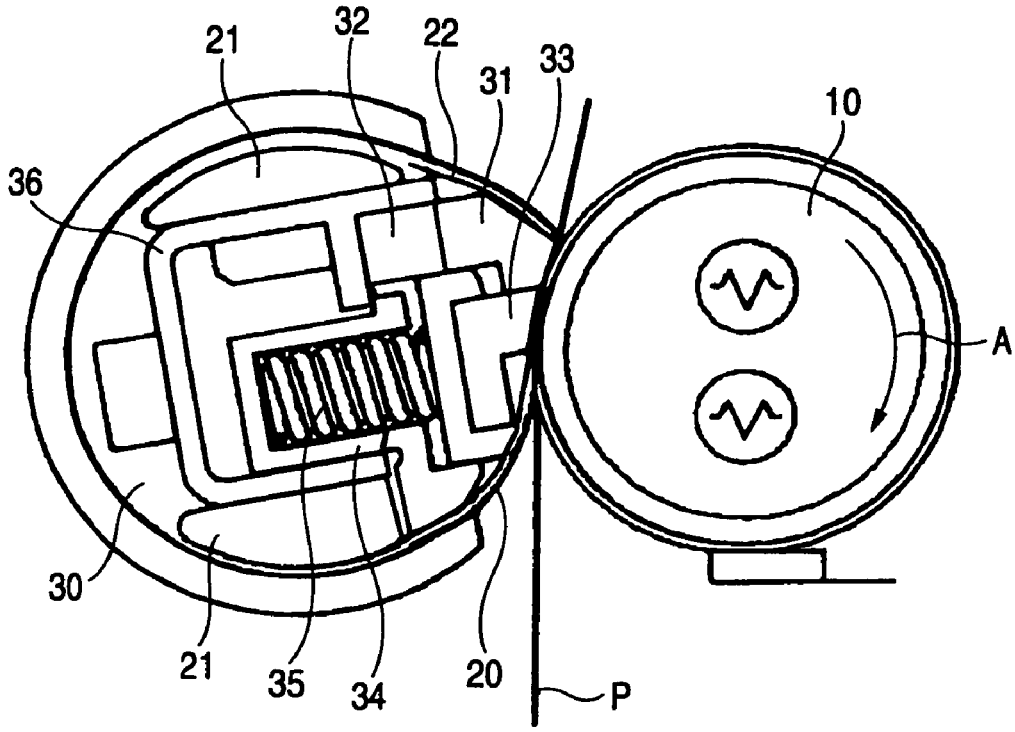
FIG. 2 is an enlarged schematic sectional view of a fixing roller and a pressure member.

FIG. 2 is an enlarged schematic sectional view of the fixing roller and the pressure member. The fixing roller 10 rotates in an arrow A direction by a motor (not shown), whereby the endless belt 20 is driven to rotate. A sheet of paper P to which a toner image is transferred by a transfer device (not shown) placed on the front side in the process direction is conveyed to the fixing device. While the sheet of paper P is being pinched in the nip portion, which is a contact part between the fixing roller 10 and the endless belt 20, the sheet of paper P is conveyed to the subsequent stage in the process direction by rotation of the fixing roller 10 and rotation of the endless belt 20, that is, in a direction in which the rotation of the fixing roller 10 and the rotation of the endless belt 20 convey the sheet of paper P.

In the nip portion, while the sheet of paper P is pressed by the pressure given by the pressure member 30 from the inside of the endless belt 20, heat of the heating source such as a halogen lamp disposed in the fixing roller 10 is given to the paper P from the fixing roller 10. Thus, the toner image transferred to the sheet of paper P is heated and pressurized to fix the toner image thereon.

The cylindrical core of the fixing roller 10 uses a metal material having high thermal conductivity such as iron, aluminum or stainless steel. The endless belt 20 includes a base layer and a mold release layer formed on the surface of the base layer. A material selected from among polyimide, polyamide and polyamideimide is used for the base layer. A layer coated with a fluorocarbon resin is used as the mold release layer.

A frame 36 for supporting the contact member 31, the adjustment member 32 and the pressure pad 33 is disposed inside the endless belt 20. The pressure pad 33 is attached to a moving part of a holder 34. The moving part is urged by a spring 35 built in the holder 34, to thereby press the endless belt 20 through the pressure pad 33. A guide 21 for causes the endless belt 20 to have a circular orbit as much as possible is provided on the periphery of the frame 36, in order to achieve smooth rotation of the endless belt 20.

In the nip portion, to lessen sliding resistance between the rotating endless belt 20 and the fixed contact member 31 and between the rotating endless belt 20 and the fixed pressure pad 33, a low-friction sheet 22 is disposed between the contact member 31 and the endless belt 20 and between the pressure pad 33 and the endless belt 20. A material having a small friction coefficient and abrasion resistance may be used as the sheet 22. For example, a glass fiber sheet impregnated with a fluorocarbon resin or a fluorocarbon resin sheet may be used.

Figure 8:
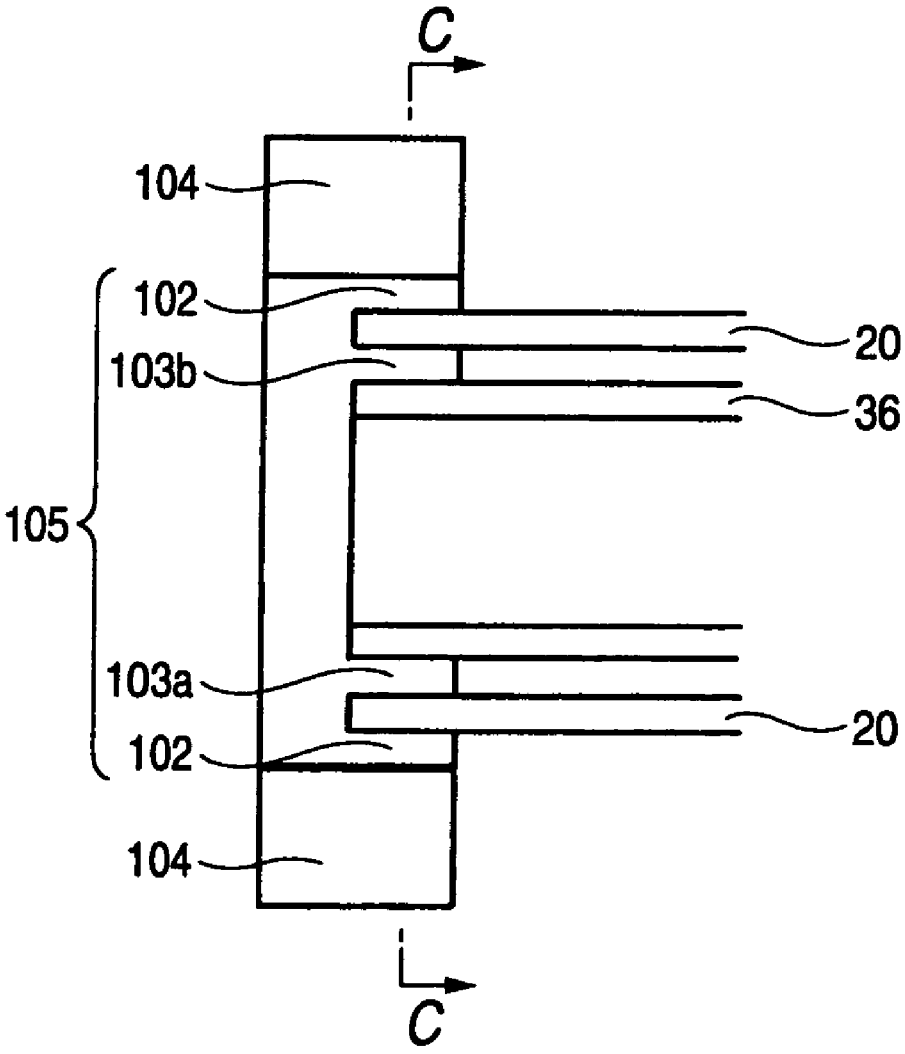
FIG. 8 is a section view taken along a line VIII-VIII in FIG. 1, and shows an end portion of a belt 20.

The frame 36 for pressing the contact member 31, the adjustment member 32 and the pressure pad 33 is held by an arm 104. Specifically, end caps 105 are fitted to the both ends of the belt 20 as shown in FIG. 8, which is a section view taken along a line VIII-VIII in FIG. 1. Each end cap 105 has first parts 102, which have a substantially C shape in the section view when taken along a line C-C (for example, see FIG. 1), and second parts 103*a*, 103*b*, which look separate parts in the section view. As shown in FIG. 8, the first parts 102 and the second parts 103*a*, 103*b* are formed integrally to constitute the end cap 105. Each first part 102 and the corresponding second part 103*a* (103*b*) sandwich the belt 20 therebetween so that the belt 20 has a substantially tube shape. Furthermore, the second parts 103*a*, 103*b* support the frame 36 therebetween. The arm 104 supports the first end cap 102 from the outside. Also, the arm 104 is attached to a main body of the fixing device 1 with a screw 100 (see FIG. 1). A spring 101 between the head portion of the screw 100 and the arm 104 is compressed to urge the arm 104 in an arrow direction B. Since the spring 101 urges the arm 104 in the arrow direction B, the arm 104 urges the end cap 105 in the substantially right direction in FIG. 1. Thus, the end cap 105 urges the frame 36 in the substantially right direction in FIG. 1, so as to apply a press force to the contact member 31, the adjustment member 32 and the pressure pad 33 toward the fixing roller 10. If the pressure force applied to the arm 104 is adjusted by tightening or loosening the screw 100, the press force applied to the pressure member 30 in the nip portion can be adjusted.

In the fixing device of the exemplary embodiment having such a configuration, the pressure member 30 includes the contact member 31 and the adjustment member 32, which are separate members. FIGS. 3 to 6 are schematic perspective views to show examples of the structure of the pressure member incorporated in the exemplary embodiment. In the examples, the figures show a state in which the contact member 31 and the adjustment member 32 are apart from each other, for the purpose of facilitating understanding of the description. However, the contact member 31 and the adjustment member 32 are placed on the frame 36 with the contact member 31 and the adjustment member 32 put on each other.

Each of the contact members 31 of the pressure members shown in FIGS. 3 to 6 has a mountain shape at its top in a sectional view and has the same sectional shape along the sectional view direction. Therefore, to form the contact member 31, for example, if a rod-like material is extruded out of a mold having a hole of the sectional shape mentioned above, the contact member 31 can be molded easily. Here, for example, a metal such as aluminum is used as the material of the contact member 31.

Next, examples of the adjustment member 32 shown in FIGS. 3 to 6 will be discussed. In the example shown in FIG. 3, the top of the adjustment member 32 (on the contact-member 31 side) is formed like a staircase and steps are formed so that the center step is the thickest and other steps become thinner toward both ends from its center. The contact member 31 and the adjustment member 32 are placed on the frame 36 shown in FIG. 2 in a state where the contact member 31 is placed below the adjustment member 32 in the figure so that the adjustment member 32 and the contact member 31 are superposed.

Since the bottom of the adjustment member 32 is flat, when pressure is applied to the adjustment member 32 from the frame 36, the contact member 31 bends in a state where the contact member 31 circumscribes the corners of the staircase shape on the top of the adjustment member 32. This means that the contact member 31 bends with the center as a convex part in accordance with the staircase shape of the adjustment member 32. At this time, the corners of the staircase shape support the bottom of the contact member 31 by line contact and a predetermined pressure distribution is generated.

Figure 4:
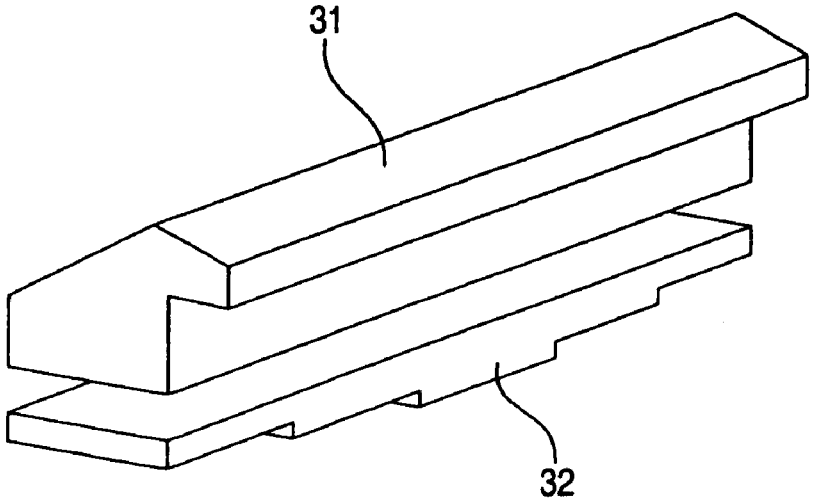
FIG. 4 is a schematic perspective view to show an example of a structure of the pressure member incorporated in the exemplary embodiment of the invention (No. 2)

In the example shown in FIG. 4, the bottom of the adjustment member 32 (opposite side to the contact member 31) is formed like a staircase, and steps are formed so that the center step is the thickest and other steps become thinner toward both ends from the center. The contact member 31 and the adjustment member 32 are placed on the frame 36 shown in FIG. 2 in a state where the contact member 31 is placed below the adjustment member 32 in the figure so that the adjustment member 32 and the contact member 31 are superposed.

Since the top of the adjustment member 32 is flat, the portion being in contact with the contact member 31 becomes plane contact, but the corners of the staircase shape on the bottom of the adjustment member 32 circumscribe the frame 36 and the adjustment member 32 bends accordingly. This means that the contact member 31 bends in accordance with the adjustment member 32. At this time, the frame 36 supports the bottom of the adjustment member 32 due to the corners of the staircase shape with the adjustment member 32 being in a line contact with the frame 36. Thus, a predetermined pressure distribution is generated.

Figure 3:
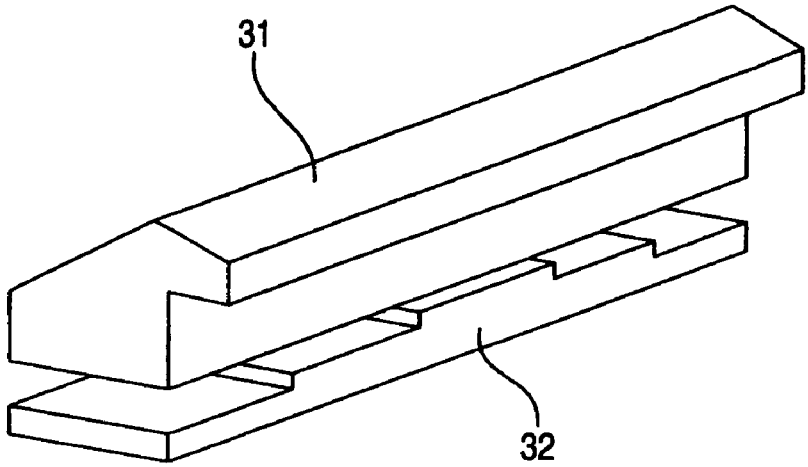
FIG. 3 is a schematic perspective view to show an example of a structure of the pressure member incorporated in the exemplary embodiment of the invention (No. 1)

The number of the steps of the staircase shape and the size of each step in the adjustment member 32 having the staircase shape shown in FIGS. 3 and 4 are set appropriately according to the pressure distribution when the adjustment member 32 is combined with the contact member 31.

Figure 5:
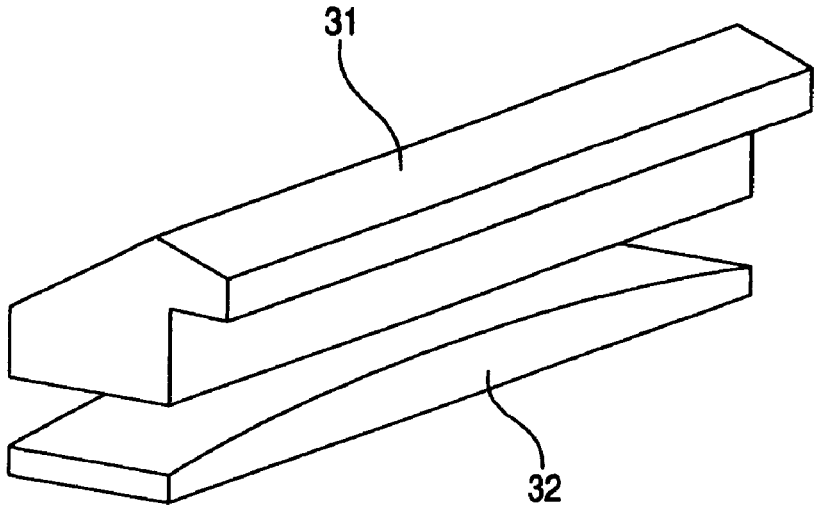
FIG. 5 is a schematic perspective view to show an example of a structure of the pressure member incorporated in the exemplary embodiment of the invention (No. 3)

In the example shown in FIG. 5, the top of the adjustment member 32 (on the contact-member 31 side) is formed like a curved surface with the center swelling. The adjustment member 32 is formed so that its center is the thickest and becomes thinner from the center toward both ends thereof. The contact member 31 and the adjustment member 32 are placed on the frame 36 shown in FIG. 2 in a state where the contact member 31 is placed below the adjustment member 32 in the figure so that the adjustment member 32 and the contact member 31 are superposed.

Since the bottom of the adjustment member 32 is flat, when pressure is applied to the adjustment member 32 from the frame 36, the contact member 31 bends along the curved surface shape of the top of the adjustment member 32. This means that the contact member 31 bends with the center as a convex part in accordance with the curved surface shape of the adjustment member 32. Accordingly, a predetermined pressure distribution is generated.

Figure 6:
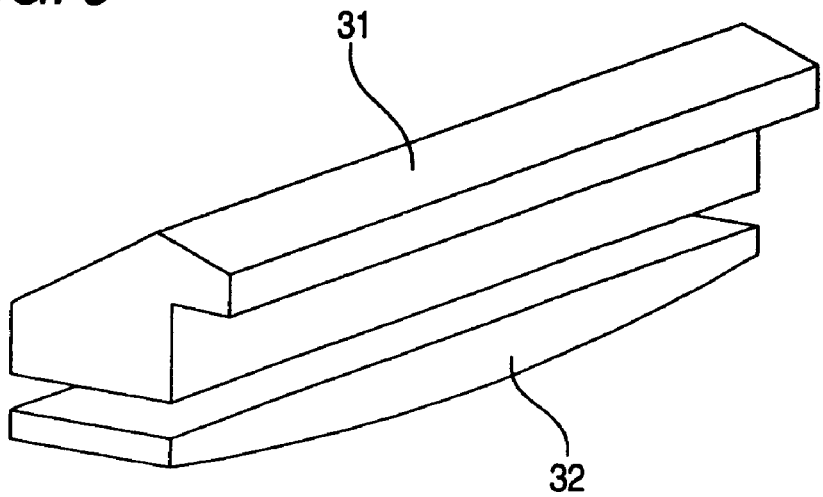
FIG. 6 is a schematic perspective view to show an example of a structure of the pressure member incorporated in the exemplary embodiment of the invention (No. 4)

In the example shown in FIG. 6, the bottom of the adjustment member 32 (opposite side to the contact member 31) is formed like a curved surface with the center swelling. The adjustment member 32 is formed so that its center is the thickest and becomes thinner from the center toward both ends thereof. The contact member 31 and the adjustment member 32 are placed on the frame 36 shown in FIG. 2 in a state where the contact member 31 is placed below the adjustment member 32 in the figure so that the adjustment member 32 and the contact member 31 are superposed.

Since the top of the adjustment member 32 is flat, the portion being contact with the contact member 31 becomes plane contact. However, the curved surface shape of the bottom of the adjustment member 32 is placed in contact with the frame 36 and the adjustment member 32 bends accordingly. This means that the contact member 31 bends in accordance with the adjustment member 32. Accordingly, a predetermined pressure distribution is generated.

In the exemplary embodiment, the pressure member 30 includes the contact member 31 and the adjustment member 32, which are separate members, as mentioned above. Therefore, if the adjustment member 32 is of a complicated shape, the same shape and the same sectional shape are adopted as the contact member 31 and it is made possible to easily manufacture the pressure member 30 (contact member 31).

Aluminum may be used as the contact member 31. Thus, for example, rod-like aluminum is extruded out of a mold, whereby the contact members 31 having the same sectional shape can be manufactured easily. In place of aluminum, a metal, such as titanium and stainless steel, may be used as the contact member 31.

For example, a resin, such as a liquid crystal polymer, may be used as a material of the adjustment member 32. Therefore, a complicated shape would be able to be easily manufactured by injection molding with a mold, etc. That is, when the contact member 31 and the adjustment member 32 are formed of separate members as the pressure member 30 as in the exemplary embodiment, each member having a shape for providing any desired pressure distribution can be easily manufactured and it is made possible to reduce the cost of the fixing device.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a cylindrical fixing roller;

an endless belt that rotates along with the fixing roller, the endless belt disposed at a position facing the fixing roller; and a pressure member disposed inside the endless belt, the pressure member pressurizing the fixing roller via the endless belt, wherein:

the pressure member comprises:

a contact member that directly contacts with the endless belt; and an adjustment member that adjusts distribution of pressure given by an urging member to the contact member, and the adjustment member is made of a liquid crystal polymer.

2. The device according to claim 1, wherein the adjustment member is in line-contact with the contact member.

3. The device according to claim 1, wherein the adjustment member has a staircase shape.

4. The device according to claim 1, wherein the adjustment member has a curved surface shape.

5. The device according to claim 1, wherein the contact member is made of a metal.

6. The device according to claim 5, wherein the metal comprises one selected from a group consisting of aluminum, titanium and stainless steel.

7. An image formation apparatus comprising:

a photosensitive drum;

an exposure unit that exposes the photosensitive drum to form an electrostatic latent image on the photosensitive drum;

a developing device that develops the electrostatic latent image with toner;

an intermediate transfer belt onto which a toner image formed on the photosensitive drum is transferred;

a transfer roller that transfers the toner image from the intermediate transfer belt to a recording medium; and the fixing device according to claim 1, the fixing device that fixes the toner image onto the recording medium.

* * * * *